United States Patent [19]

Goff

[11] 4,249,350

[45] Feb. 10, 1981

[54] ABRASIVE THROWING WHEEL AND IMPROVED BLADE ASSEMBLY

[76] Inventor: James R. Goff, 6601 Shawnee Dr., Oklahoma City, Okla. 73116

[21] Appl. No.: 3,689

[22] Filed: Jan. 15, 1979

Related U.S. Application Data

[63] Continuation of Ser. No. 850,763, Nov. 11, 1977, abandoned.

[51] Int. Cl.[3] ..... B24C 5/06

[52] U.S. Cl. ..... 51/434; 51/435

[58] Field of Search ..... 51/434, 435; 416/221; 241/275, 300

[56] References Cited

U.S. PATENT DOCUMENTS

| | | | |
|---|---|---|---|
| 2,819,562 | 1/1958 | Barnes | 51/434 |
| 3,352,064 | 11/1967 | DeGroot | 51/434 |
| 3,513,597 | 5/1970 | DeGroot | 51/435 |
| 3,841,794 | 10/1974 | Bergmann | 416/221 |
| 3,867,791 | 2/1975 | Goff | 51/434 |
| 3,944,091 | 3/1976 | Tillmanns | 241/300 X |
| 4,047,843 | 9/1977 | Zeidler | 51/434 |

FOREIGN PATENT DOCUMENTS

| | | | |
|---|---|---|---|
| 1131118 | 6/1962 | Fed. Rep. of Germany | 51/435 |
| 1057779 | 11/1953 | France | 51/434 |
| 2308468 | 4/1975 | France | 51/435 |
| 743381 | 1/1956 | United Kingdom | 51/434 |
| 1167525 | 10/1969 | United Kingdom . | |
| 1390958 | 4/1975 | United Kingdom . | |

*Primary Examiner*—Gary L. Smith

*Attorney, Agent, or Firm*—Beveridge, DeGrandi, Kline and Lunsford

[57] ABSTRACT

A combination comprising a blade block for mounting on an abrasive throwing wheel and a blade for mounting on the blade block is provided. The blade has a front surface and a rear surface, a first opening on the rear surface and a second opening on the rear surface spaced from the first opening. The blade block is provided with projecting means, such as a lug, adapted for insertion in the first opening on the rear of the blade. An abutment means contacts the rear of the blade. An opening in the blade block is provided, and the opening is intermediate the projecting means and the abutment means on the blade block. The blade is held in position on the blade block by locking means, such as a deformable, resilient wire, adapted for insertion in the second opening on the rear of the blade and for insertion in the opening in the blade block. The assembly comprised of the blade block, throwing blade and locking means is particularly useful in a rotatable, centrifugal, abrasive throwing device of the type frequently used for throwing sand, metal shot and other particulate material onto a surface to be cleaned.

11 Claims, 5 Drawing Figures

ABRASIVE THROWING WHEEL AND IMPROVED BLADE ASSEMBLY

This is a continuation of application Ser. No. 850,763 filed Nov. 11, 1977, now abandoned.

BACKGROUND OF THE INVENTION

This invention relates to a rotatable abrading device, and more particularly, to a mechanical device for propelling abrasive materials at abrading velocities against a surface to be treated. Such devices are commonly known as centrifugal blasting machines or abrasive throwing wheels. This invention also relates to an assembly comprised of a blade block, a blade and a locking means for locking the blade in position on the blade block.

Centrifugal blasting machines comprising rotors or wheels having a plurality of blades installed thereon have been known in the art for many years. The blades propel an abrasive material against a work surface. Thus, they are sometimes referred to as throwing blades. Due to the action of the abrasive material on the throwing blades, the blades exhibit considerable wear over a period of time. Attempts have been made to fabricate the blades from abrasion-resistant alloys. In other cases, special blade configuration have been employed to minimize the effects of the abrasive material on the blades.

Notwithstanding these attempts to minimize wear and extend the life of the throwing blades, periodic blade removal and replacement is necessary. This results in a loss of valuable operating time. Furthermore, while the blades must be removable, they must also be held so securely that they will resist the tremendous centrifugal forces exerted on them when the wheel is operating.

Several methods have been proposed for securing the blades in a removable manner to the throwing wheel. One method involves securing the blades to the front side of a wheel disk, usually by means of a bolt or by means of radial grooves in the wheel, frequently of a dove-tail shape. Another method employs two wheel disks that are maintained in spaced-apart relation. Longitudinal narrow edges of the throwing blades are generally inserted into radial grooves arranged in opposing surfaces of the two disks. Auxiliary means, such as bolts, pivotal locking means, eccentrics, set screws, etc. can be employed to secure the blades against radial displacement. Examples of these devices can be found in U.S. Pat. No. 2,819,562, U.S. Pat. No. 3,352,064 and U.S. Pat. No. 3,654,736. Blade replacement is not always easy because the blades "freeze" or become jammed in the grooves.

Another arrangement is shown in U.S. Pat. No. 3,894,360. In this case, the blades are mounted on brackets having an angular cross-section, and the brackets, in turn, are mounted on the throwing wheel. The rear of each blade is provided with a cast-in insert stud, which is adapted for insertion through an opening in the angular bracket. The stud is provided with a slot adapted to receive a clip, which holds the blade in position on the angular bracket. The only securing means in this arrangement is comprised of the stud and the spring clip. Should either the stud or spring clip fail, such as by the blade wearing thin around the area of the stud, the blade will fly off the wheel.

Another arrangement is shown in U.S. Pat. No. 3,867,791, the entire disclosure of which is relied upon and incorporated herein by reference. In this case, the throwing blade is secured to the wheel by means of a blade block, which is mounted on the wheel. Each blade block has a first groove near an inner end of the block and a second groove near an outer end. Each blade includes lugs for insertion in the grooves. There is a centrally disposed impeller that restricts the movement of the blades, particularly in a radial direction. This is accomplished by employing an impeller having a shoulder that contacts the inner end of the blade. While a degree of commercial success has been achieved with this device, the rear of the blade must generally be machined in the area where it contacts the impeller. This adds to the cost of the blades. Additionally, it has been found to be rather difficult to cast the blade of the type disclosed in the patent because of its large cross-sectional area.

In short, there exists a need in the art for improved means for securing the throwing blades to the wheel of a centrifugal blasting machine. The throwing blades must be securely mounted on the throwing disk to prevent movement of the blades, especially in a radial direction. The blades must be easily removed and replaced without the need for special tools. Preferably, the blades should not be susceptible to "freezing" or jamming in position, as is frequently encountered when the blades are installed in grooves on the disk of the abrasive blasting machine. When the blade is installed in the centrifugal blasting machine, it should be possible to replace the blade without removing the internal parts of the blast machine, such as the impeller or control cage conventionally found in such machines. The means used for locking the blade in position should be suitable for use with any length and width of blade. The assembly should not require machining and close tolerances characteristic of prior art devices. For commercial reasons, the blade and blade block assembly should be adapted to fit centrifugal blasting machines now on the market.

SUMMARY OF THE INVENTION

This invention aids in fulfilling these needs in the art by providing, in combination, a blade block adapted for mounting on an abrasive throwing wheel. A blade is supported by and detachably connected to the blade block. The blade has an inner end, an outer end, a forward surface and a rear surface. Cooperating engagement means are provided on the blade block and the blade for permitting inward movement of the blade while preventing substantial outward movement thereof relative to the blade block. An abutment means on the blade block acts as a bearing or driving surface for the blade. The abutment surface is located outwardly of the engagement means and usually contacts the rear surface of the blade. The abutment means substantially prevents rearward movement of the blade without obstructing its forward movement. Locking means substantially prevents inward movement of the blade relative to the blade block in order to prevent disengagement of the cooperating engagement means.

More particularly, this invention provides, in combination, a blade block for mounting on an abrasive throwing wheel and a blade for mounting on the blade block. The blade has a front surface and a rear surface. The blade has a first opening on the rear surface and a second opening on the rear surface spaced from the first opening. The blade block has means for engaging the first opening in the rear of the blade. Preferably, this is a rigid projecting means, such as a lug means, on the blade block adapted for insertion in the first opening on the rear of the blade. Also provided on the blade block is an abutment means to act as a bearing surface or driving surface for the blade. Preferably, the abutment means is adapted to contact the rear of the blade. Additionally, the blade block has an opening therein. Preferably, this opening is intermediate the rigid projecting means and the abutment means on the blade block. The blade is locked in position on the blade block by locking means adapted for insertion in the second opening in the rear of said blade and for insertion in the opening in the blade block.

This invention also provides, in combination, an abrasive throwing wheel, a plurality of circumferentially spaced blade blocks on the wheel, and a plurality of radially extending blades, each blade secured to the wheel by one of the blade blocks and each of the blades having a front surface and a rear surface. Each of the blades has a first opening on the rear surface and a second opening on the rear surface spaced from the first opening. Each of the blade blocks has a lug means adapted for insertion in the first opening on the rear of the blade, an abutment means adapted to contact the rear of the blade, and an opening intermediate the lug means and the abutment means. Locking means for insertion in the second opening on the rear of the blade and for insertion in the opening in the blade block locks the blade in position on the wheel.

Also provided by this invention is an improved rotatable, centrifugal, abrasive throwing device comprising a driven wheel, a plurality of circumferentially spaced blade blocks on the wheel and a plurality of radially extending blades, each of the blades secured to the wheel by one of the blade blocks. Each of the blades has a front surface and a rear surface. A central opening is provided in the driven wheel. A hollow, vaned, driven impeller is mounted in the central opening and is rotatable with the wheel. A stationary control cage around the impeller has an opening therein for the passage of abrasive material from the impeller onto the blades. Means are provided for feeding particulate, abrasive material to the impeller. More particularly, this invention provides an improvement wherein each of the blades has a first opening on the rear surface and a second opening on the rear surface opposite and spaced from the first opening. Each of the blade blocks has a rigid projecting means adapted for insertion in the first opening on the rear of the blade. An abutment means adapted to contact the rear of the blade is also provided on the blade block. Additionally, the blade block has an opening intermediate the rigid projecting means and the abutment means. Locking means adapted for insertion in the second opening in the rear of the blade and for insertion in the opening in the blade block is provided to thereby lock the blade in position on the wheel.

This invention also provides a replaceable blade for use in this invention. More particularly, the blade is for use on a centrifugal, abrasive throwing machine. The blade has an inner end, an outer end, a front surface and a rear surface. The front surface comprises an unobstructed continuous surface for throwing particles at abrading velocities. The rear surface has a first projection thereon proximate the inner end. The first projection has an opening therein facing the outer end of the blade. The rear surface also has a second projection thereon intermediate the first projection and the outer end of the blade. The second projection has an opening therein facing the opening in the first projection.

BRIEF DESCRIPTION OF THE DRAWINGS

This invention will be more fully understood from the detailed description which follows and by reference to the accompanying drawings which depict the blade block, throwing blade and locking means of this invention and a centrifugal blasting machine according to this invention, and detailed views of its various parts. In the drawings.

DETAILED DESCRIPTION OF THE INVENTION

Figure 1:
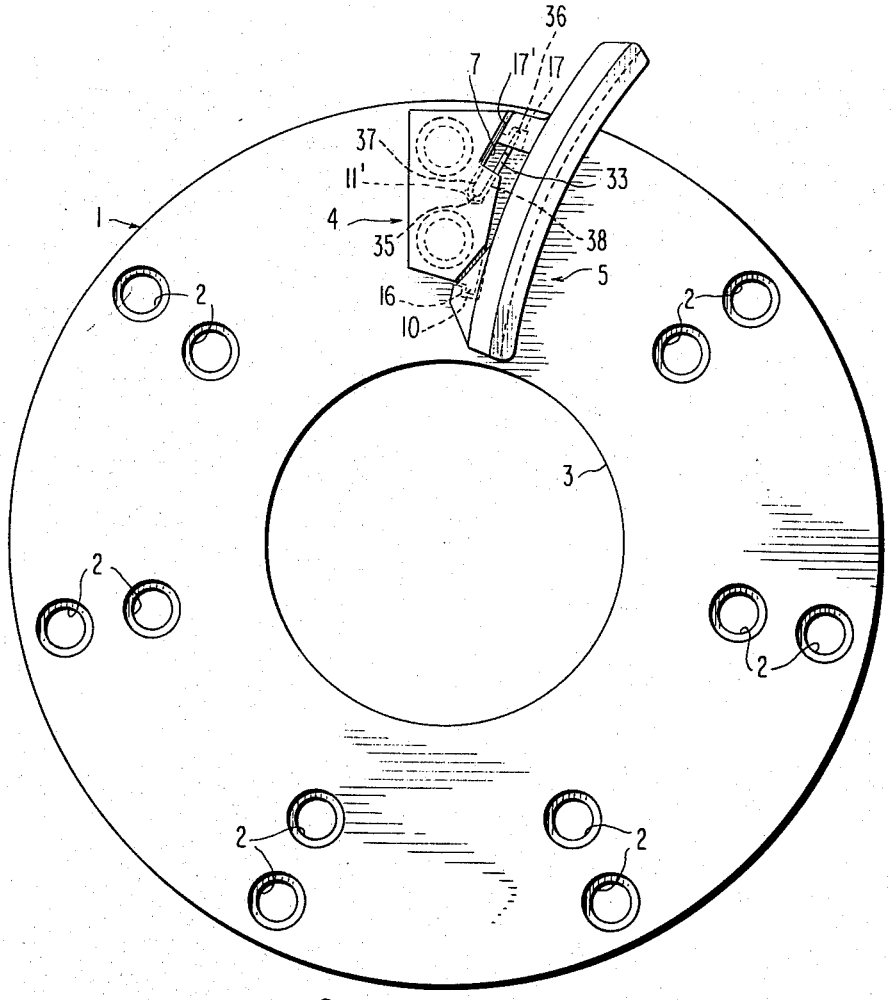
FIG. 1 is a plan view of a throwing wheel having a blade block and throwing blade installed thereon.

Referring to FIG. 1, there is depicted a wheel or disk generally designated as 1. The wheel has a plurality of holes 2 uniformly spaced circumferentially therein. Holes 2 are adapted for the insertion of bolts employed to secure blade blocks, such as blade block 4, to the wheel 1. Preferably, the wheel 1 has an opening 3 centrally disposed therein and of a size sufficient to accommodate a portion of an impeller, which is described hereinafter. Shown in FIG. 1 are blade block 4 and blade 5 in a typical position on the wheel 1. The blade block 4 and blade 5 will be described in greater detail hereinafter. Also shown in FIG. 1 is locking means 33, which locks the blade 5 in position on the blade block 4. Locking means 33 is a locking spring described in greater detail hereinafter.

The portion of the device depicted in FIG. 1 is adapted for rotation in a clockwise direction. The blade 5 shown in the FIGURE is curved in the direction of rotation. Other blade configurations can be employed. For example, a substantially straight blade or blade having a different curvature would be satisfactory.

Figure 2:
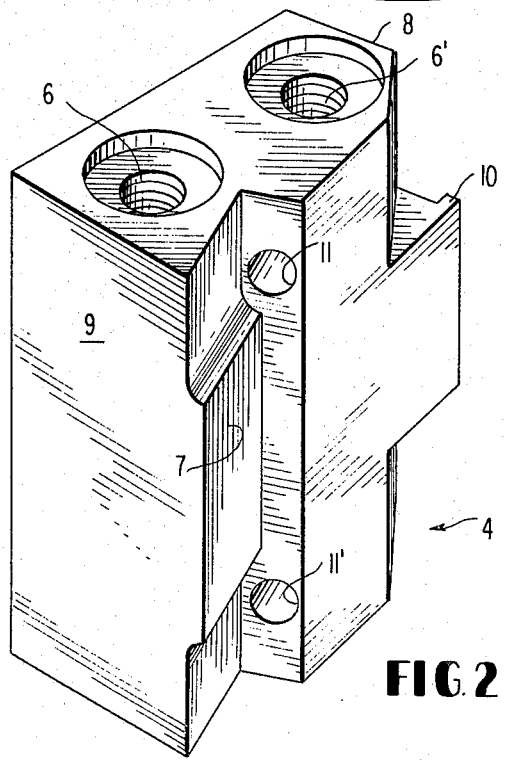
FIG. 2 is a view of a preferred configuration for a blade block.

Referring to FIG. 2, there is depicted a bottom view of a preferred blade block employed in the device of this invention. The blade block generally designated as 4 has two drilled and tapped holes 6 and 6′ therein. Blade block 4 can be secured to wheel 1 by inserting bolts through holes 2 in wheel 1 into holes 6 and 6′ in blade block 4. Blade block 4 has an inner end 8 and an outer end 9. A lug 10 is provided on the blade block proximate the inner end 8. Blade block 4 is also provided with a surface 7 located outwardly of the lug 10. Surface 7 acts as an abutment means adapted to contact the rear of the blade. This abutment means acts as a bearing surface for the outward portion of the blade as the blade is rotating with the wheel in a clockwise direction. Proximate the outer end 9 and intermediate surface 7 and lug 10 there are provided drilled holes 11 and 11′, which are adapted to receive the legs of the locking spring 33 described hereinafter.

Figure 3:
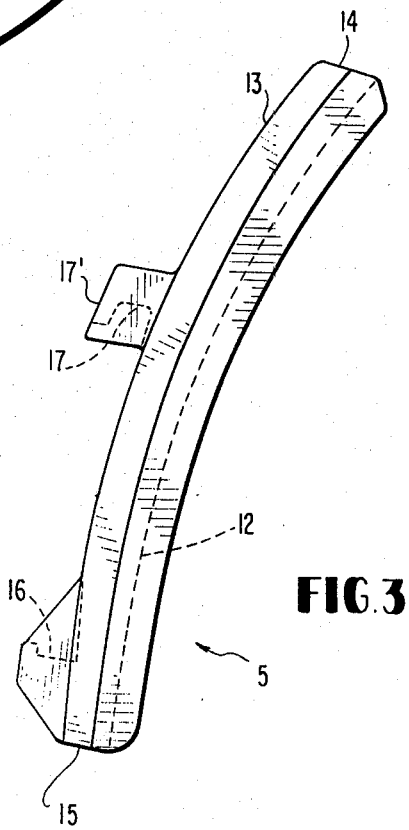
FIGS. 3 and 5 are views of a preferred configuration for a throwing blade.
Figure 5:
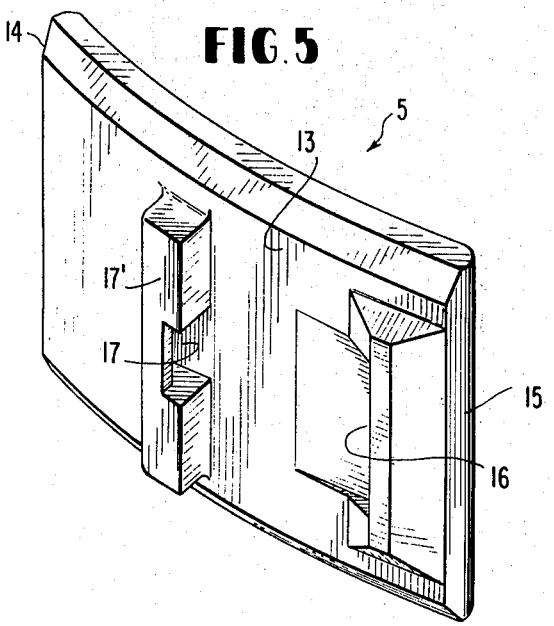

In FIG. 3 there is depicted a preferred blade employed in the device of this invention. The blade, generally designated as 5, comprises an unobstructed, continuous, smooth surface 12 for throwing abrasive. Surface 12 is the front surface of the blade. The blade also has a rear surface 13, an outer end 14 and an inner end 15. The blade 5 has a first opening 16 near its inner end 15. Intermediate the outer end 14 and the inner end 15 of blade 5 is a second opening 17 on the rear surface 13 of the blade. It will be apparent from FIGS. 3 and 6 that the openings 16 and 17 are cavities facing each other and formed in protrusions on the rear surface 13 of the blade. Opening 16 is adapted for engagement with the rigid lug 10 on blade block 4. The wall 17' of cavity 17 is adapted to contact the abutment means 7 on blade block 4 and to shield the locking means from stray abrasive. Cavity 17 receives a portion of the locking spring described hereinafter. It will be evident from FIG. 5 that the wall 17' of cavity 17 is cut away slightly to facilitate insertion of the locking spring 33 shown in FIG. 1.

Figure 4:
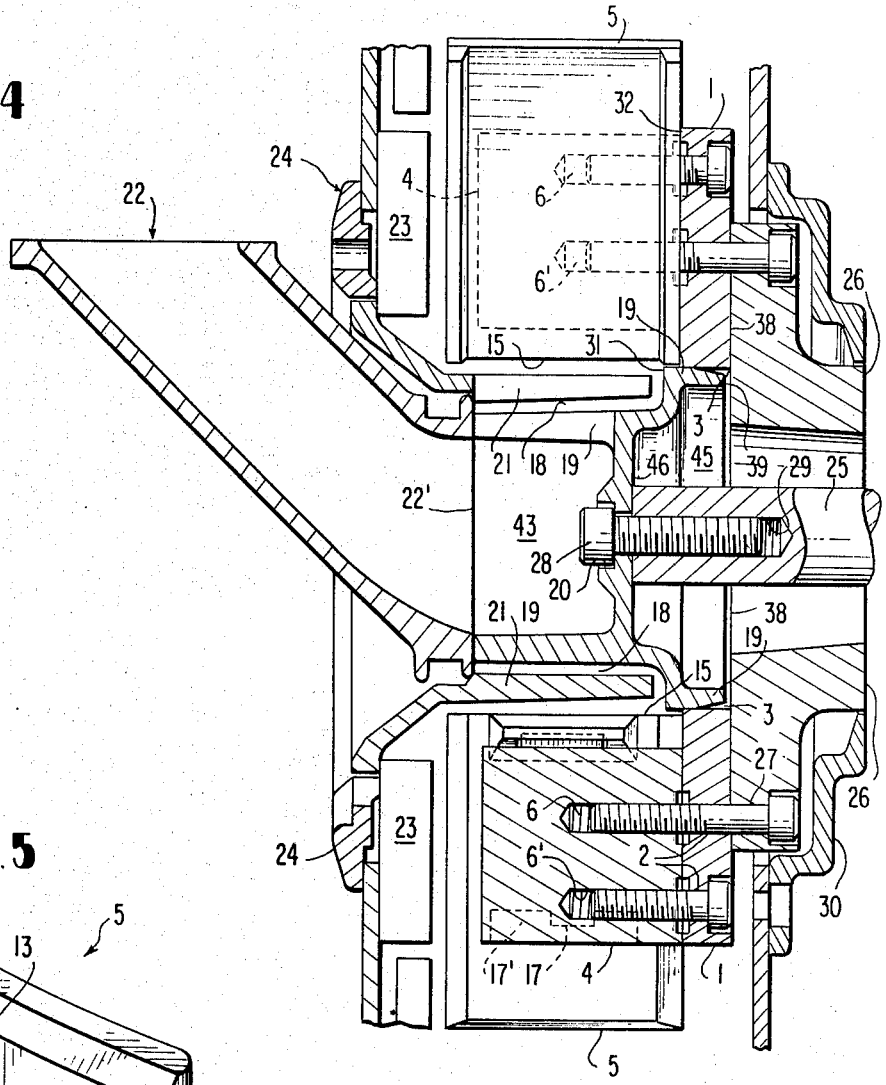
FIG. 4 is a detail view of the central portion of a centrifugal blasting machine according to this invention.

Referring next to FIG. 4, there is depicted a detailed view of the central portion of a blasting machine of this invention. The wheel 1 has mounted thereon throwing blades 5 by means of blade blocks 4. The inner ends 15 of the blades 5 define a central opening 18. Inserted in the opening 18 is a hollow, vaned impeller 19 having a bolt hole 20 therein. Surrounding the impeller 19 is a control cage 21 having an opening (not shown) therein for the passage of abrasive material from the impeller 19 onto the blades 5. The device also includes means for feeding particulate, abrasive material to the impeller. This feeding means is shown in FIG. 4 as a feed spout 22. A cage retainer 23 and cage adaptor 24 secure the control cage 21 within the blasting machine in a conventional manner.

The wheel 1 is driven by a motor (not shown) having a motor shaft 25. A hub 26 is mounted on shaft 25 by means of a conventional center tapered-lock bushing (not shown). The hub 26 includes bolt holes shown as 27. The wheel 1 is installed on the hub 26, and bolt hole 27 on the hub is aligned with a bolt hole 2 on the wheel. Blade blocks 4 are then installed so that holes 6 and 6' in the blade block are aligned with holes 2 in the wheel 1. The blade blocks 4 can then be bolted to the hub-wheel assembly.

Blades 5 are installed on the blade block 4. The impeller 19 is inserted in the central opening 18. Preferably, a wheel 1 having an opening 3 is employed, and the impeller 19 projects at least partially into this opening as shown in FIG. 4. The impeller 19 preferably has a slot cast into its face, which interfaces with a pilot hole machined in the vertical surface 38 of the hub 26 to thereby center the impeller 19 within the wheel 1 and the opening 3. A pin can be inserted in the hub pilot. The pin projects from the face of the hub and aligns with the slot cast into the impeller 19. This pin not only aligns the impeller slot with the hub pilot, but also provides a positive means of driving the impeller with the hub-wheel assembly. The pilot holes and pin are not shown in the FIGURES. To complete the assembly, a bolt 28 is inserted through opening 20 in impeller 19 and into a threaded opening 29 in motor shaft 25. A hub seal and retainer 30 can be installed in a conventional manner.

The blade and blade block of this invention are particularly advantageous because they can be used with commercially available centrifugal blasting machines. For instance, the device of this invention can be employed with an impeller of the type described in U.S. Pat. No. 3,867,791 and as also described in FIG. 4 herein, wherein the impeller retards movement of the blades radially inwardly. As shown in FIG. 4, a shoulder 31 projects above the surface 32 of wheel 1 onto which the blade block and blade are mounted. Of course, it will be understood that other impeller configurations can be employed in the device of this invention. With new machines, it is preferred that a space be provided between the rear of the blade and the impeller because machining of the rear surface of the blade is thereby made unnecessary.

In FIG. 1, there is shown a locking spring generally designated as 33. It is comprised of a deformable, resilient wire bent to form two substantially parallel leg members 35. As shown, the terminal portion of each leg member 35 is bent over to form a hook. This arrangement is advantageous because the portion 37 of the hook forming leg 35' can be bent closer to or farther away from the portion 38 to assure that leg 35 fits snugly into hole 11 in blade block 4. The corresponding portions of the parallel leg can be similarly adjusted to assure that leg fits snugly in hole 11'. Of course, other configurations can be employed. The locking spring 33 is also provided with a projection 36, the center line of which is substantially parallel to center lines through the longitudinal portions of each of the leg members. The projection 36 is adapted for insertion in cavity 17 on the rear of blade 15. (See FIGS. 1 and 3).

With reference to FIG. 1, it will be readily apparent that the blade block and blade assembly can easily be mounted on wheel 1. Once the blade block 4 has been mounted on wheel 1 by means of bolts inserted through holes 2 on the wheel and into holes 6 and 6' in the blade block (see FIG. 2), the locking spring 33 can be installed in blade block 4 by inserting the parallel legs into the holes 11 and 11', respectively, of blade block 4. The projection 36 on locking spring 33 will then extend beyond the adjacent surfaces of the blade block 4. Blade 5 is then located in position so that lug 10 on blade block 4 fits into cavity 16 on the rear of the blade. The outer end 14 of blade 5 can then be rotated counterclockwise until abutment 7 contacts the exterior wall 17' of cavity 17. Projection 36 (see FIG. 1) can be depressed until it clears the cut-out portion of the wall 17' (see FIG. 5), and then allowed to snap back into its normal position or until the projection 36 fits into the cavity 17 on the rear of blade 5. The greater the distance between the parallel legs, the easier it will be to deflect the projection 36 to a sufficient extent to pass through the cut away portion of the wall 17'. When the blade 5 has been assembled to blade block 4 by means of the locking spring 33, the lug 10 substantially prevents outward movement of blade 5, but does not prevent inward movement of the blade. Locking spring 33 will ordinarily be in compression. This forces blade 5 in an outward direction and assures that the lug 10 on blade block 4 fits snugly against the surfaces forming cavity 16 on the rear of the blade. This also aids in keeping the blade properly oriented on the wheel, e.g. the blade does not cock out of position. It will be understood, however, that locking spring 33 can be under substantially no stress in its installed position, since the centrifugal force exerted on blade 5 as wheel 1 rotates will cause the blade to move outwardly to a point where lug 10 restricts further outward movement of the blade thereby holding the blade in place. Thus, even if the locking means fails during operation of the blast wheel, the blade will remain in place until the wheel stops rotating. Also, lug 10 and cavity 16 are provided with clearance fit so that they substantially prevent movement of the blade in an upward direction (i.e., away from the wheel). In any case, the locking means substantially prevents inward movement of the blade with respect to the blade block and holds the blade in position on the wheel when the wheel is not in motion.

With reference to FIG. 1, the significance of the abutment means 7 provided on blade block 4 can also be appreciated. It is shown located outwardly of the cooperating engagement means comprised of the lug 10 and cavity 16. The abutment means serves as a bearing surface or driving surface for the blade since the rear surface of the blade contacts the abutment means 7. Thus, the abutment means is located so as to substantially prevent backward movement of the blade as the wheel rotates at high speed in a clockwise direction. As shown in FIG. 1, it is preferred that the abutment means contact the rear of the blade nearer the outer end than the inner end of the blade in order to minimize the cantilevered portion of the blade beyond the abutment means.

Reference to FIG. 1 will also make it clear that the blade 5 can be easily removed from blade block 4 for replacement or servicing. This can be readily accomplished by depressing the projection 36 on locking spring 33 until it clears the cut-out portion provided in the wall 17' (see FIG. 5) forming cavity 17. A blow on the tip of the blade with a hammer sufficient for the lug 10 to become dislodged from cavity 16 will also permit easy removal of the blade if radial movement of the blade is not impeded by the impeller or other part of the blasting machine. In either case a new blade can be readily installed by repeating the procedure outlined above.

Typically, the centrifugal blasting machine of this invention will be driven by a belt connected to a motor or by direct connection to a motor shaft. The latter method is preferred and is depicted in FIG. 4. One can employ either a locked bearing or a floating motor shaft. The latter is preferred and can be employed with the impeller and control cage arrangement disclosed in U.S. Pat. No. 3,867,791. Therein a control cage is disclosed, which does not wrap around the surface of the impeller as is conventional in the art. The impeller is generally mounted on the motor shaft, and when the impeller and motor shaft move inward and outward, as is common with a motor having a floating motor shaft, there is no interference between the control cage and the impeller.

Conventional impellers can also be employed in practicing this invention. Likewise, the preferred impeller described in U.S. Pat. No. 3,867,791 can be employed. Therein, it is described that the impeller comprises a plurality of fingers that extend in a longitudinal direction. The outermost ends of the fingers are not connected to each other and openings are thereby formed between the fingers. The fingers are immediately adjacent the feed spout when the centrifugal blasting machine is assembled. This makes it possible to feed relatively large quantities of abrasive material to the impeller. Of course, it will be understood that conventional impellers in which the fingers are connected at their outermost ends can also be employed.

While this invention has been described in connection with a centrifugal blasting machine comprised of a single wheel disk, it will be understood that two wheel disks maintained in spaced apart relation can also be employed.

There are a number of advantages associated with this invention. First of all, means are provided for rigidly securing a throwing blade to a blasting wheel. Movement of the blades in a radial direction or in a rearward direction is substantially prevented making for a very safe device. The blades can be removed relatively easily and quickly replaced. Special assembly and disassembly tools are not required. While the device of this invention can employ blades inserted in grooves in the throwing wheel, the use of such grooves is not necessary and will generally be avoided since blades frequently become wedged or frozen in such grooves. Lost production time is minimized because of the ease and speed with which blades can be serviced or replaced. It is not necessary to remove any of the internal parts in the centrifugal blasting machine to replace the blades according to this invention. It has been found that the blades can be fabricated using less metal than required to fabricate blades of the type described in U.S. Pat. No. 3,867,791. The locking design of this invention can be adapted to any length or width of blade. Because of the close interface between the lug on the blade block and the cavity on the rear of the blade, the locking means is much stronger than with prior art devices. Since the machine tolerances of the parts employed in this invention are not as critical as in prior art devices, the throwing blades do not have to be ground and polished to fit in place. Importantly, the blade and blade block of this invention can be interchanged with the blade and blade block of the type disclosed in U.S. Pat. No. 3,867,791, making this invention operable with centrifugal blasting machines commercially available today.

A preferred method of installing blades on the blade blocks comprises locating blade 5 in position so that cavity 17 has encased wire projection 36. The outer end 14 of blade 5 is then rotated so that rear surface 13 is laying against block projection 10. By applying sufficient force downward on blade 5 at 14 to deflect locking means 33 cavity 16 of blade 5 can then be rotated to a position which will accept lug 10 of block 4 when force on blade 5 is released.

What is claimed is:

1. In a rotatable centrifugal abrasive throwing device comprising a driven wheel; a plurality of circumferentially spaced blade blocks on said wheel; a plurality of radially extending blades, each of said blades secured to said wheel by one of said blade blocks, each of said blades having a front surface and a rear surface; a central opening in said driven wheel; a hollow, vaned, driven impeller mounted in said central opening rotatable with said wheel; a stationary control cage around said impeller, said control cage having an opening therein for the passage of abrasive material from said impeller onto said blades; and means for feeding particulate, abrasive material to said impeller; the improvement wherein each of said blades has a first opening on said rear surface and a second opening on said rear surface opposite and spaced from said first opening;

each of said blade blocks has a rigid projecting means adapted for insertion in said first opening on the rear of said blade, an abutment means adapted to contact the rear of said blade, and an opening intermediate said projecting means and said abutment means; and locking means of a deformable, resilient material for insertion in said second opening in the rear of said blade and for insertion in said opening in said blade block, to thereby lock said blade in position on said wheel.

2. Combination as claimed in claim 1 wherein said locking means is in compression when said blade is locked in position on said wheel.

3. Combination as claimed in claim 1 wherein said blade has an inner end and an outer end, said openings on the rear of said blade are cavities facing each other and formed in protrusions on the rear of said blades, said rigid projecting means is a lug means on said blade block that substantially prevents outward movement of said blade with respect to said blade block, and said locking means substantially prevents inward movement of said blade with respect to said blade block.

4. Combination as claimed in claim 3 wherein said abutment means contacts the rear of said blade nearer said outer end than said inner end.

5. The combination of a blade block for mounting on an abrasive throwing wheel with a blade for mounting on said blade block, said blade having a front surface, a rear surface, an inner end and an outer end;

wherein said blade has a first opening on said rear surface proximate said inner end and a second opening on said rear surface spaced from said first opening and proximate said outer end, said openings being cavities opposing each other and formed in protrusions on the rear of said blade;

wherein said blade block has rigid lug means for engagement in said first opening on the rear of said blade, and said blade block also has abutment means that functions as a bearing surface for contacting the rear of said blade and thereby rendering support to said blade when said blade is in motion on said wheel, and an opening intermediate said lug means and said abutment means, and deformable, resilient locking means for insertion in said second opening in the rear of said blade and for insertion in said opening in said blade block to thereby lock said blade in position on said blade block and restrict disengagement of said lug from said first opening.

6. Combination as claimed in claim 3 wherein said locking means is in compression when said blade is locked in position on said wheel.

7. The combination of an abrasive throwing wheel with a plurality of circumferentially spaced blade blocks on said wheel; a plurality of radially extending blades, each blade secured to said wheel by one of said blade blocks, each of said blades having a front surface, a rear surface, an inner end and an outer end;

wherein said blade has a first opening on said rear surface proximate said inner end and a second opening on said rear surface spaced from said first opening and proximate said outer end, said openings being cavities opposing each other and formed in protrusions on the rear of said blade;

wherein said blade block has rigid lug means for engagement in said first opening on the rear of said blade, and said blade block also has abutment means that functions as a bearing surface for contacting the rear of said blade and thereby rendering support to said blade when said blade is in motion on said wheel, and an opening intermediate said lug means and said abutment means; and deformable, resilient locking means for insertion in said second opening in the rear of said blade and for insertion in said opening in said blade block to thereby lock said blade in position on said blade block and restrict disengagement of said lug from said first opening.

8. Combination as claimed in claim 7 wherein said abutment means contacts the rear of said blade nearer said outer end than said inner end.

9. A rotatable centrifugal abrasive throwing device comprising a driven wheel; a plurality of circumferentially spaced blade blocks on said wheel; a plurality of radially extending blades, each of said blades secured to said wheel by one of said blade blocks, each of said blades having a front surface, a rear surface, an inner end and an outer end; a central opening in said driven wheel; a hollow, vaned, driven impeller mounted in said central opening rotatable with said wheel; a stationary control cage around said impeller, said control cage having an opening therein for the passage of abrasive material from said impeller onto said blades; and means for feeding particulate, abrasive material to said impeller;

wherein each of said blades has a first opening on said rear surface proximate said inner end and a second opening on said rear surface spaced from said first opening and proximate said outer end, said openings being cavities opposing each other and formed in protrusions on the rear of said blades;

wherein each of said blade blocks has rigid lug means for engagement in said first opening on the rear of a blade, and each of said blade blocks also has abutment means that functions as a bearing surface for contacting the rear of a blade and thereby rendering support to said blade when said blade is in motion on said wheel, and an opening intermediate said lug means and said abutment means; and deformable, resilient locking means for insertion in said second opening in the rear of a blade and for insertion in said opening in the corresponding blade block to thereby lock said blade in position on said blade block and restrict disengagement of said lug from said first opening.

10. Combination according to claim 9 having means for feeding abrasive to said wheel and means for distributing said abrasive to said blades.

11. The combination of a blade block for mounting on an abrasive throwing wheel with a blade for mounting on said blade block, said blade having a front surface, a rear surface, an inner end and an outer end;

wherein said blade has a first opening on said rear surface proximate said inner end and a second opening on said rear surface spaced from said first opening and proximate said outer end, said openings being cavities opposing each other and formed in protrusions on the rear of said blade;

wherein said blade block has rigid lug means for engagement in said first opening on the rear of said blade, and said blade block also has abutment means that functions as a bearing surface for contacting the rear of said blade and thereby rendering support to said blade when said blade is in motion on said wheel, and an opening intermediate said lug means and said abutment means; and deformable, resilient locking means for insertion in said second opening in the rear of said blade and for insertion in said opening in said blade block to thereby lock said blade in position on said blade block and restrict disengagement of said lug from said first opening;

whereby said blade is removable from said blade block by moving said blade longitudinally to compress said resilient locking means sufficiently for said rigid lug means to disengage said first opening.

* * * * *